United States Patent [19]

Houle et al.

[11] 4,260,147

[45] Apr. 7, 1981

[54] UTILIZATION OF AIR JETS FOR DISCHARGE CONVEYOR ON WICKETING SYSTEMS

[75] Inventors: Philip J. Houle, Smithfield, R.I.; Robert G. Oliver, South Dartmouth, Mass.

[73] Assignee: Gloucester Engineering Co., Inc., Gloucester, Mass.

[21] Appl. No.: 909,000

[22] Filed: May 24, 1978

[51] Int. Cl.[3] ..... B65H 29/68; B65H 29/40

[52] U.S. Cl. ..... 271/182; 271/186; 271/83

[58] Field of Search ..... 271/66, 70, 83, 182, 271/183, 186, 187, 189, 194–197, 229, 276

[56] References Cited

U.S. PATENT DOCUMENTS

| | | | |
|---|---|---|---|
| Re. 27,523 | 11/1972 | Maccherone . | |
| 2,924,454 | 2/1960 | MacEvoy | 271/83 |
| 3,075,760 | 1/1963 | Frederick . | |
| 3,523,686 | 8/1970 | Cawley . | |
| 3,683,730 | 8/1972 | Driessen | 271/64 X |
| 3,944,218 | 3/1976 | Cerny | 271/82 X |

*Primary Examiner*—Robert W. Saifer

*Attorney, Agent, or Firm*—Orrin M. Haugen; Thomas J. Nikolai

[57] ABSTRACT

A conveyor positioner arrangement for sequentially controlling the positioning of flexible plastic film products in a substantially stationary position on a stacker input station, with gaseous discharge means being utilized to provide certain of the control for the film product, and including means for establishing a Bernoulli effect pressure reduction along a plane beneath the flexible plastic film product. The gaseous discharge means establishing a Bernoulli effect reduction comprises a plurality of generally parallelly arranged spaced apart nozzles which have their respective discharge orifices disposed generally beneath the plane of travel of the flexible plastic film products to deliver a flow of compressed gaseous fluid, such as air, along such plane. The pressure reduction established by the gaseous flow stream is sufficient to draw the plastic film product downwardly into at least partial or floating contact with the surface forming the stacker input station so as to position the product thereupon on a reliable and repeatable basis. A second gaseous discharge arrangement may optionally be provided along a plane above the plane of travel of the film product in order to achieve additional control for repeatable positioning of the film product.

3 Claims, 7 Drawing Figures

UTILIZATION OF AIR JETS FOR DISCHARGE CONVEYOR ON WICKETING SYSTEMS

BACKGROUND OF THE INVENTION

The present invention relates generally to an improved conveyor positioner system for flexible plastic film products, and particularly a high speed conveyor for handling flexible plastic film products as they are sequentially delivered in non-captive form from a web converting apparatus such as a flexible plastic film bagmaking machine or the like. Bagmaking machines for the fabrication of film products from polyethylene are examples of such apparatus, and are in common usage in the art.

As the speed of the web converting apparatus increases, the problem of handling the flexible plastic film products increases significantly, and particularly the handling of the product as it is delivered or discharged from the apparatus. While various techniques have been and are being used for controlling the handling and positioning of flexible plastic film products as they are delivered from a converting apparatus, problems continue to exist with respect to repeatability of product placement, and also with respect to the delivery of film products in repeatable and controlled form.

The fabrication or conversion of plastic material into individual products such as bags is commonplace. Such bags, normally formed of polyethylene, have a wide variety of applications. In certain instances, the user of certain larger size bags employs a wicket pin for retention of a quantity of individual bags in a stack, with the bags normally containing uniform perforations or holes at or along one of the ends, such as along an upper lip extension. The presentation and disposition of the bag product during loading onto the wicket member presents delivery problems, since the individual bags, upon delivery from the converting equipment, must be uniformly placed upon a stacker input station for ultimate delivery to the wicket member. Stacker apparatus which has been used in the past is disclosed in U.S. Reissue Pat. No. 27,523 and U.S. Pat. No. 3,921,827, with such stacking apparatus employing a rotary hub carrying bag retaining arms for receiving the individual bags at a stacker input station, for ultimate delivery onto a wicket member.

As can be appreciated, the problems encountered with handling the plastic film products such as bags increase significantly as machine speed is increased. Plastic film products are exceedingly difficult to handle at high rates of speed because of the inherent flimsiness of the film material and the inherent viscosity of the ambient air. The film products become distorted, fold, or flex so that uniform pick-up and later delivery to the ultimate disposition may be adversely affected, the later delivery being dependent upon the accuracy at which the product may be delivered to the input station. In other words, any misalignment, folding or other anomalies in the form of the product will be reflected in adverse stacking conditions and may result in a jamming situation, damaged product, or an unattractive arrangement of finished product.

In order to assist in controlling the positioning of the film product as it leaves a captive conveyor, and enters the stacker input station, it has been found that control of the positioning may be enhanced by utilization of the Bernoulli effect. The pressure of a flowing stream of gaseous fluid is effectively reduced as its speed of flow is increased. This phenomena has generally been known as the "Bernoulli effect", and may be derived theoretically from the Bernoulli Theorem. It is this phenomena which is utilized to reduce the pressure in the stream of gaseous fluid beneath the plane of the flexible plastic film article so as to draw the article down and into partial or floating contact with a stationary receiving platen or platform. In order to achieve an affect from the pressure drop, this platform must be, of course, discontinuous so as to expose the flexible plastic film article to the zone of reduced pressure. Accordingly, a grid-work arrangement may be effectively utilized as the receiving surface and stacker input station for flexible plastic film articles or products upon discharge or release from a moving conveyor. While a stationary grid is ordinarily preferred, in certain applications, a series of endless belts may be utilized, with these belts being driven at a predetermined speed so as to provide a moving platform. In certain other applications, it may be desirable to employ a combination of moving endless belts and a stationary grid, with the grid, in such a situation, providing a datum plane controlling horizontal downward movement of the product.

In order to achieve the Bernoulli effect, the nozzles utilized for the discharge of compressed gaseous fluid, such as air, are arranged to have their orifices direct the gas flow along a line or axis generally parallel to the direction of motion or travel of the film article. Since the platen or platform for receiving the articles is disposed along a plane which is above the plane of the discharge orifices, the reduction in pressure due to the Bernoulli effect overcomes the tendency of the moving stream of air to adversely affect the stability during travel of the plastic film article, and hence the article will normally lie flat upon the surface of the grid for pick-up by the stacker device. Thus, a relatively smooth, predictable, and repeatable path is followed by the plastic film product, thereby rendering the pick-up and subsequent placement of the product or article highly reliable.

In addition to the gaseous discharge means providing the Bernoulli effect in a plane beneath the film articles, a second set of orifices is normally provided in order to assist in control of the motion or travel of the articles. Specifically, a second set of orifices may be provided along or adjacent the hot knife, with these orifices delivering a constant flow of gaseous fluid onto the upper surface of the film articles. The specific arrangement of the second set of discharge orifices will be described in greater detail hereinafter.

The arrangement of the present invention is particularly adapted for those rotary stackers previously mentioned, such as described in U.S. Pat. No. 3,921,827. Such devices are particularly useful for handling plastic film products which have a pair of spaced bores or holes formed therein for ultimate placement upon a wicket device. In this connection, the rotary stacker device will have pairs of arms extending radially outwardly from a central core, with these arms being, of course, spaced radially parallelly, one to another, outwardly from the core. The grid or other surface for receiving the plastic film products will normally be spaced between the opposed radially extending arms, with the arms being arranged, therefore, to pick up articles as deposited upon the grid.

The utilization of a discharge of compressed gaseous fluid, such as air, provides a greater degree of stability for the film products carried on the rotary stackers as described in U.S. Pat. No. 3,921,827. Specifically, a pressure reduction occurs at the trailing surface of a film product as it moves in its orbital path, and the discharge of compressed gaseous fluid into this zone replenishes, equalizes, or stabilizes the air in the zone, and this pressure equalization has been found to provide additional assistance in positioning of the film article upon the receiving platen or platform. This beneficial affect is one which may not reasonably be expected if a partial vacuum were utilized to exercise control over the movement of the film article.

SUMMARY OF THE INVENTION

Therefore, it is a primary object of the present invention to provide an improved means for sequentially moving and positioning flexible plastic film products onto a base pad, the system including means for delivering a flow of compressed gaseous fluid at a plane generally below that of the plastic film product for achieving a Bernoulli effect pressure reduction due to the presence of an adjacent gaseous flow stream.

It is a further object of the present invention to provide an improved means for substantially precisely positioning plastic film products onto a base pad, wherein the plastic film products move toward the base pad at relatively high rates of speed, and wherein a plurality of gaseous discharge nozzles are disposed beneath the base pad for achieving a localized area of reduced pressure beneath the base pad through the Bernoulli effect, so as to control the position and velocity of the film products and position them individually upon the surface of the base pad.

It is yet a further object of the present invention to provide a means for precisely positioning individual flexible plastic film products as these products move at relatively high rates of speed from a conveyor onto a stationary or moving base pad, with means being provided to generate a zone of reduced gaseous pressure beneath the base pad so as to urge the individual flexible plastic film products into at least partial or floating contact with the base pad and ultimately into firm and secure contact with the appropriate portions of a pick-up mechanism.

Other and further objects of the present invention will become apparent to those skilled in the art upon a study of the following specification, appended claims, and accompanying drawings.

IN THE DRAWINGS

FIG. 1 is a perspective view of a system prepared in accordance with the present invention, and illustrating a rotary stacker arrangement having a base pad for receiving intermittently and sequentially delivered flexible plastic film products at a receiving zone between opposed pick-up arms, with the means for receiving the flexible plastic film products being provided with gaseous discharge nozzles for establishment of a pressure differential for assisting in the proper positioning of the plastic film products thereon;

Figure 6:
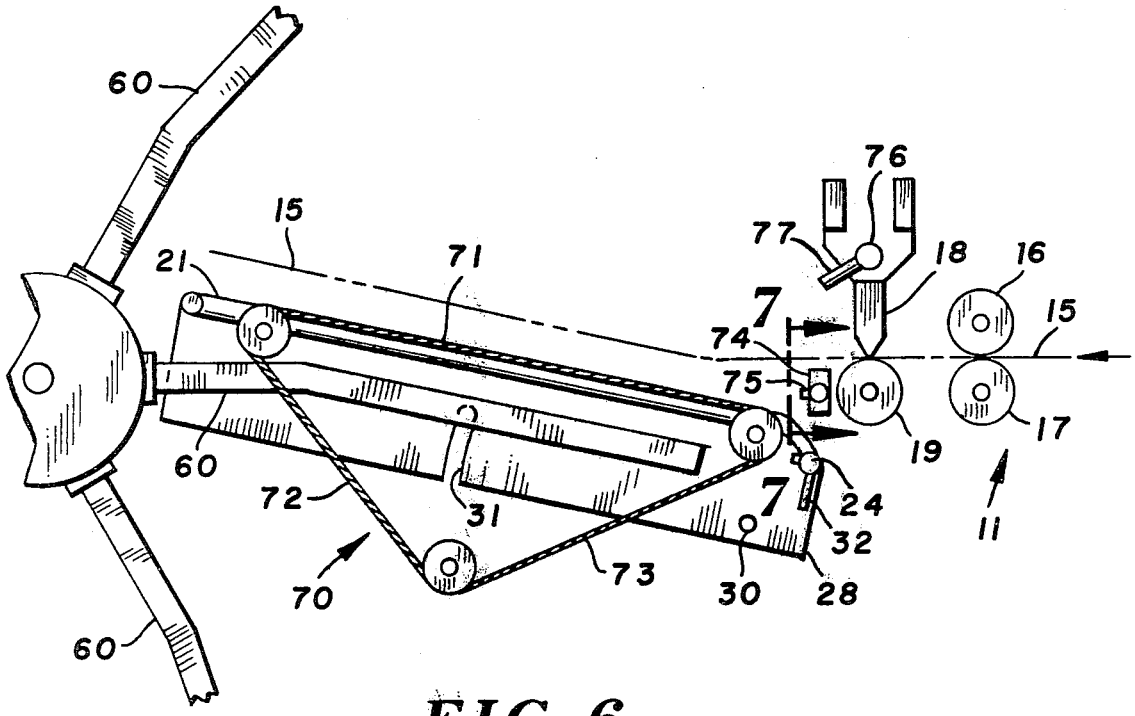
Figure 7:
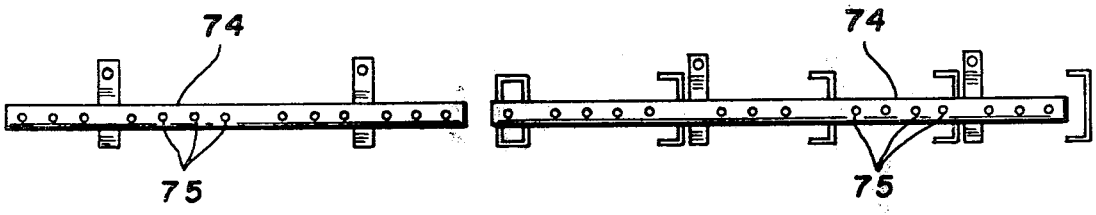

FIG. 6 is a side elevational view of a still further modified form of conveyor and product receiving system wherein the discharge of compressed gaseous fluid occurs at a point immediately adjacent the sealing-knife and sealing roll of a conventional plastic film bag-making machine; and FIG. 7 is a front elevational view of the structure illustrated in FIG. 6, and taken along the line and in the direction of the arrows 7—7 of FIG. 6.

DESCRIPTION OF THE PREFERRED EMBODIMENT

Figure 1:
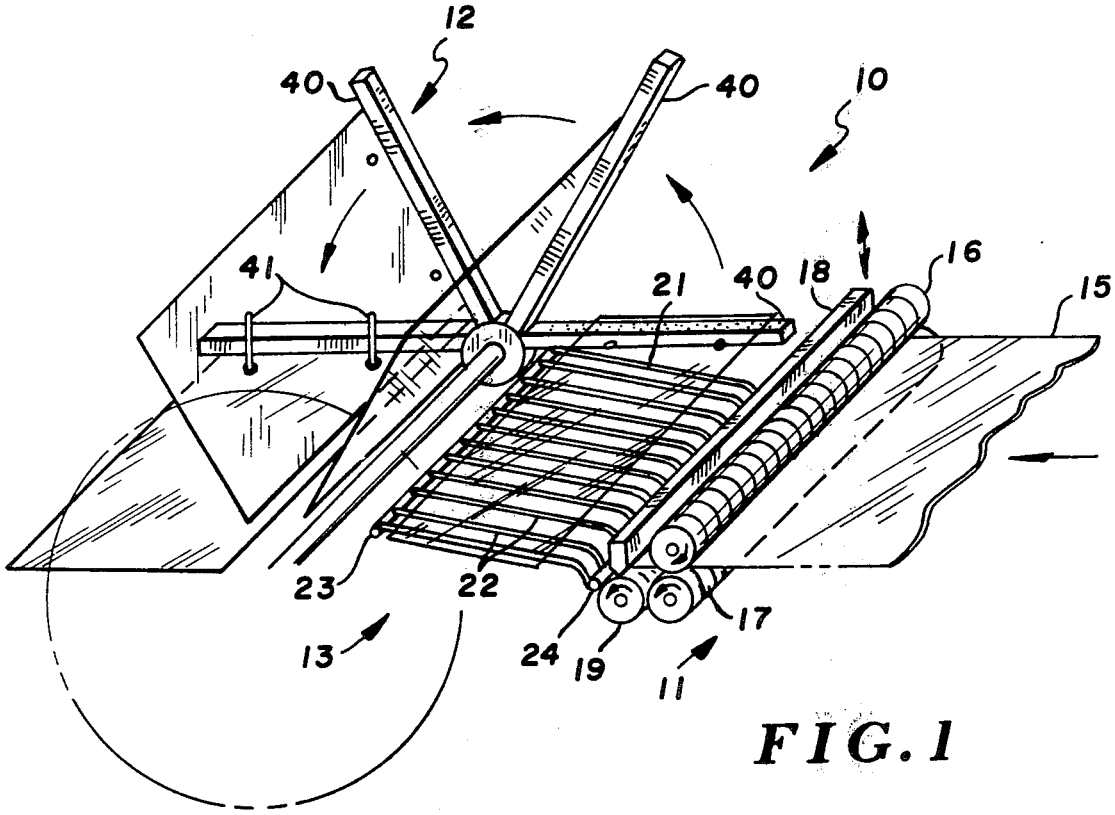
Figure 2:
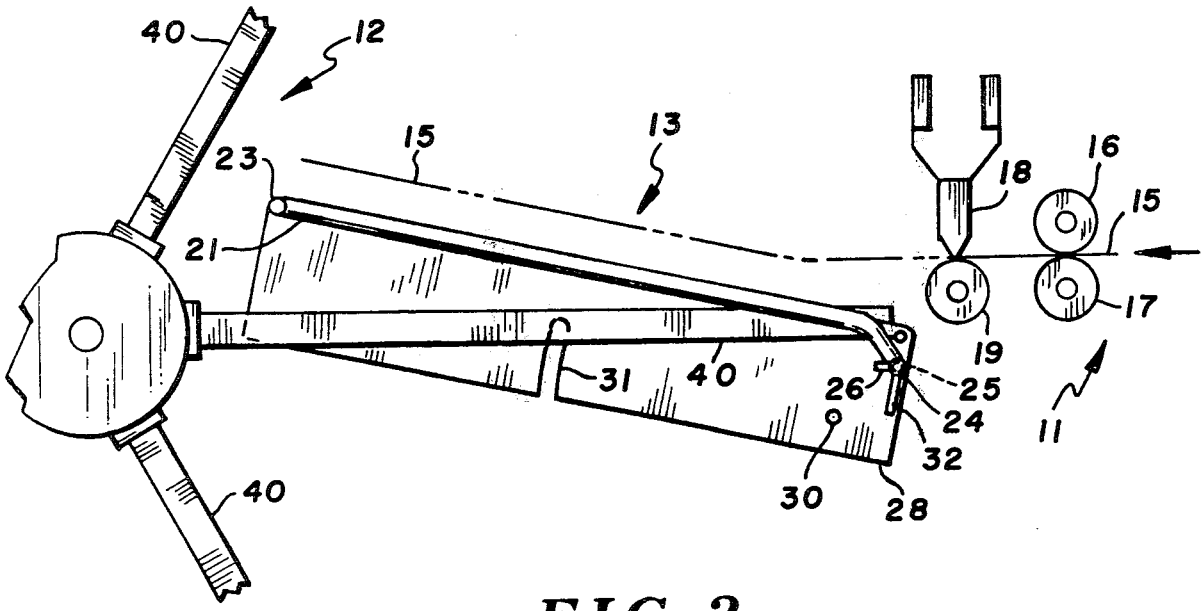
FIG. 2 is a side elevational view of the structure illustrated in FIG. 1, and further illustrating a second gaseous discharge zone which assists in control of the plastic film products as they move as free-foils through and onto the stacking arrangement of the present invention.
Figure 3:
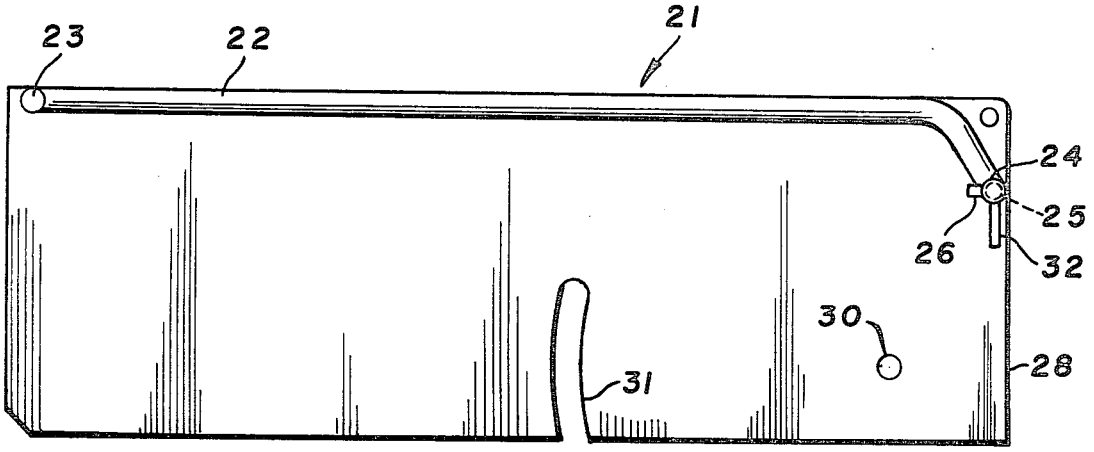
FIG. 3 is a detail view illustrating, in side elevation, a base pad in the form of a grid for receiving plastic film products thereon, the pad being provided with an array of nozzles thereunder.

With attention being directed to FIGS. 1-3 of the drawings, it will be observed that the arrangement of FIG. 1 illustrates the three components of a flexible plastic film product converting system, with the system being generally designated 10 and including a bag-making apparatus generally designated 11 (with only a fragmentary portion including the draw rolls, hot knife and sealing roll portions being shown), a rotary stacker generally designated 12, along with an intermediate product delivery or stacker input station generally designated 13. Specifically, the bag-making apparatus as illustrated may be selected from any of the commercially available varieties, with one such structure being identified as a "Model 408" machine available from Sheldahl, Inc. of East Providence, Rhode Island. Other commercially available bag-making machines may be employed, if desired, it being shown in the present system as a component of the overall system, and providing one example of a plastic film product delivering device.

Specifically, a web of film 15 is driven by a pair of draw rolls such as an upper draw roll 16 and lower draw roll 17, for ultimate delivery to a sealing knife-sealing roll combination. A typical sealing knife is shown at 18, with an opposed rotatably mounted sealing roll 19. Plastic film in the form of web 15 is advanced through intermittent periods of draw and dwell by the draw rolls 16 and 17, with the sealing knife reciprocating upwardly and downwardly so as to make periodic contact with the sealing roll and thereby sever and seal the individual layers of film forming the web 15 to form a completed bag with each cycle.

The rotary stacker 12, as previously indicated, is fabricated in accordance with the structure shown in U.S. Pat. No. 3,921,827, it being understood, of course, that other rotary stacking devices may be employed as well. Also, for purposes of this invention, the stacker need not be of the rotating variety, but may be a stacker employing spaced apart endless belts or chains driven by spaced pulleys or sprockets, as well as other configurations.

As indicated, and disposed between the bag-making machine 11 and stacker 12, is a film product receiver or stacker input station 13, with this product receiver including, primarily, a base pad 21 for receiving individual film products thereon. Base pad 21 is preferably in the form of a grid-like member having substantial gaps arranged between spaced support rods or tubes. Specifically, the system includes a plurality of spaced apart generally parallelly disposed rods 22—22 which are held together by opposed end tubes 23 and 24. End tube 23 is conventional in structure, with end tube 24 being provided with a central bore 25 or hollow core formed therein and having a plurality of radially extending bores 26—26 extending therefrom for providing nozzles for the compressed gaseous fluid contained within the core or bore 25. In order to achieve angular adjustment for the plane of the grid forming the pad 21, as may be desired, side plate 28 is provided, with this plate being pivotally mounted to a frame through bores such as bore 30, and cooperating arcuate slot 31.

In order to provide a continuous flow of compressed gaseous fluid to bore or core 25, a feed line or tube is provided as at 32, with this feed line or tube communicating with bore 25, and thus achieving a means for having a continuous flow of compressed fluid from a suitable source of such fluid, such as a compressor (not shown) along and through a conventional conduit or tubing system, also not shown. It suffices to say that the capacity of the compressor should be matched to the system employed so as to insure a constant supply of compressed gaseous fluid at a discharge pressure as determined by the operating parameters of the system. These operating parameters will be discussed more fully hereinafter.

As is apparent in FIGS. 1, 2 and 3, the nozzles formed in end tube 24 are positioned so as to achieve a discharge direction generally parallel to the top plane of the grid 21. Specifically, the discharge nozzles of end tube 24 are disposed approximately one inch below the upper surface of grid 21, it being understood, of course, that greater or closer spacing may be utilized successfully. For most applications and operations, and particularly in connection with the fabrication of plastic film bags, it has been found that the individual bores 26—26 should be spaced apart approximately one inch on center, with the diameter of the individual bores 26—26 being approximately 1/16th inch. A constant supply of compressed air has been found to achieve the purpose desired when maintained at a pressure, within manifold forming bore 25, of approximately 5 psi–15 psi. A pressure of less than 10 psi has been found to be optimum for general purposes, while pressures greater than about 15 psi have been found to generate sufficient turbulence in the area adjacent the film products so as to be deemed excessive.

As has been indicated, the radially extending arms such as arms 40—40 of rotary stacker 12 are desired for receiving the product from grid 21, and ultimately delivering the product onto spaced receiving pins 41 at the opposed side of the stacker. When these stacking machines are being operated at high speeds, the problems resulting from the tendency of one film member to "follow" its preceding member from the receiving station upwardly toward the retreating arms, may be reduced by the generation of reduced pressure due to the Bernoulli effect on the underside of the product receiving pad.

Also, as is apparent, rotating stacker 12 is provided with a drive arrangement which rotates the core at a speed synchronized with the operation of bag-making machine 11. Thus, the arrangement is such that upon occurrence of a film bag being received on base pad 21, radial arms 40 engage the bag along its body but adjacent its ends and move it through 180° of arc for transfer onto receiving pins 41. Such operation is, of course, consistent with apparatus which is now commercially available, and as is illustrated and described in U.S. Pat. No. 3,921,827.

Figure 4:
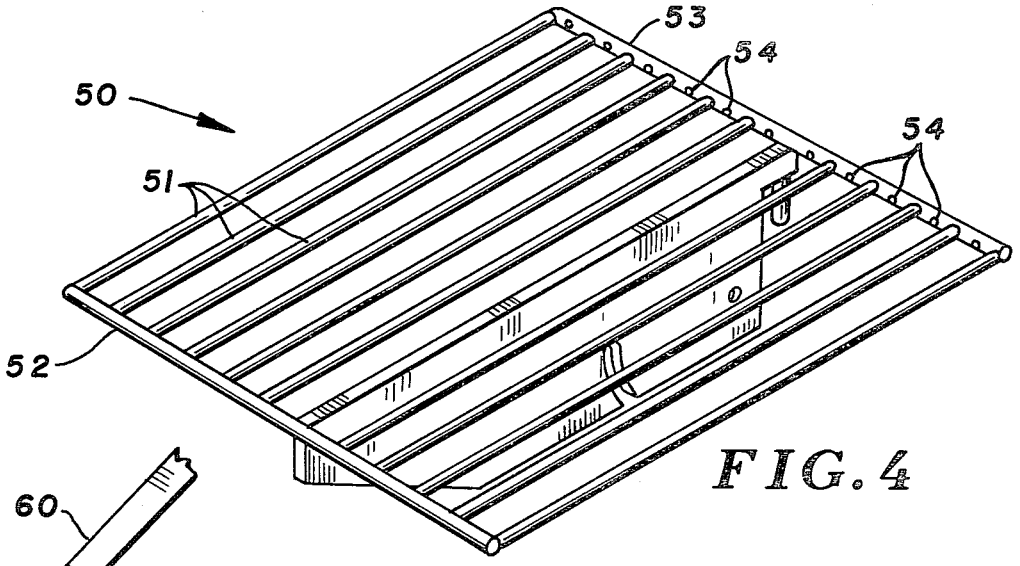
FIG. 4 is a perspective view of a modified form of base pad for use in the present invention.

Attention is now directed to FIG. 4 of the drawings wherein a modified form of product receiving grid is illustrated. The arrangement illustrated in FIG. 4 consists of a grid member 50 having a plurality of parallelly spaced bars or tubes 51—51 held rigidly in place by end tubes 52 and 53. A supply of compressed gaseous fluid is introduced into the hollow core or bore of tube 53 and is discharged through parallelly disposed and spaced apart nozzles 54—54. The design of nozzles 54—54 is, of course, similar to that described in connection with the structure of FIGS. 1–3, and specifically nozzles or orifices 26—26. it will be observed that these nozzles are likewise disposed in a plane slightly below the upper surface of the grid 50, and accordingly achieve and apply a Bernoulli effect pressure reduction on the film by virtue of the presence of the gaseous discharge stream.

Figure 5:
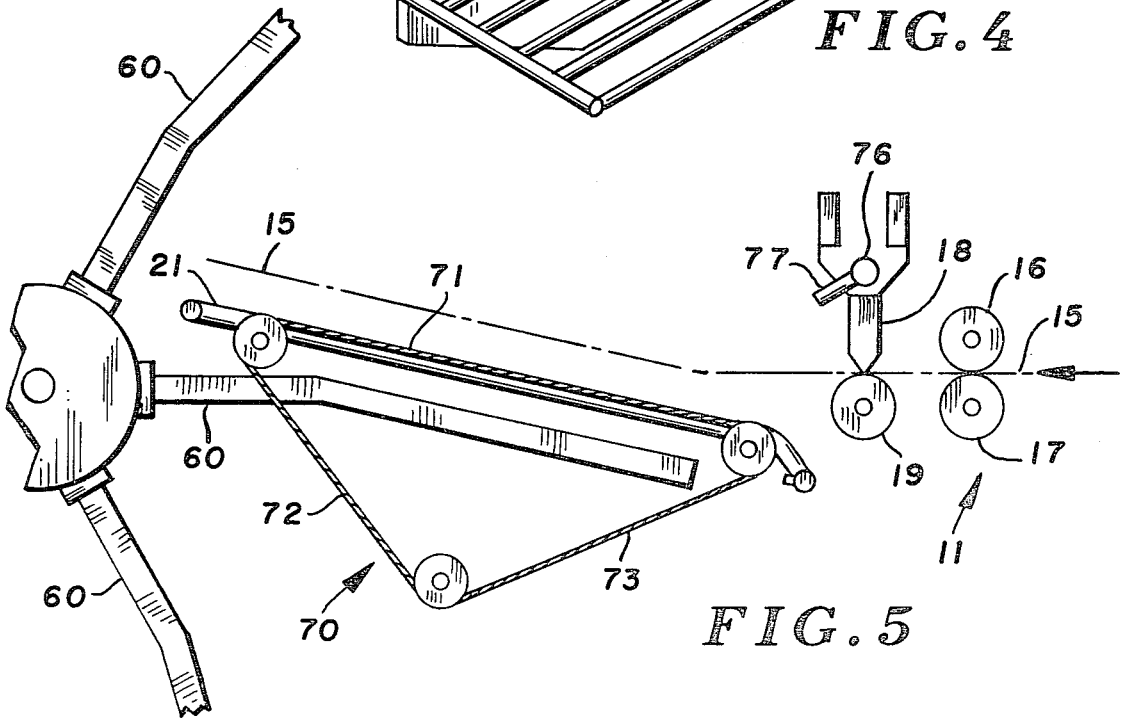
FIG. 5 is a side elevational view of a rotary stacker apparatus shown in slightly modified form from that of FIG. 2.

Attention is now directed to FIG. 5 of the drawings wherein a modified form of pick-up arm is illustrated. In this arrangement, the pick-up arm 60 is arranged with a dog-leg design so as to achieve a radial disposition which is generally parallel to the plane of the grid for receiving the film product. It has been found that in certain applications, the surface of the grid, such as the grid 50, should be ramped upwardly or tilted from the plane of travel, with the arrangement of FIG. 5 showing a ramp elevation of approximately 28° from the horizontal. In certain instances, a roller ramp elevation may be deemed appropriate, such as, for example, a ramp angle of approximately 15° from the horizontal. This angle of tilt tends to accommodate the normal disposition and direction of travel of film products as they are discharged at high speed from the discharge end of bag-making machine 11. The angular tilt of the pad, therefore, is matched by the dog-leg design of the individual pick-up arm 60 for enhanced pickup, it having been found that the preferred pick-up arrangement is one wherein the angle of the pick-up arm is substantially parallel to that of the grid, where contact is made between the pick-up arms and the film product. It will be appreciated that the utilization of a dog-leg design for the pick-up arms may present some additional problems upon release of the film product from the pick-up arms. Specifically, in a situation wherein the film product is being deposited upon parallel upstanding pins, it is generally desirable that the product be released from the pick-up arms at a point when the plane of the film product is substantially normal to the axis of the pins. Accordingly, in certain instances, it may be desirable to reduce the angle of tilt of the grid so that it is generally less than the 28° shown in FIG. 5. In this connection, and as previously mentioned, a ramp angle of approximately one-half, or about 15° has been found to be effective.

Attention is now directed to FIG. 6 of the drawings wherein a still further modified form of structure is illustrated with air-discharge bars being mounted directly on the frame of the bag-making machine, and thereby discharging air to achieve a Bernoulli effect pressure reduction in the area immediately adjacent the point of discharge of the film product from a bag-making machine. In addition, and as has been found useful in certain applications, parallelly disposed rope-belt conveyors are provided to assist in support, retention, and movement of the plastic film article as it leaves the converter machine. The rope-belt conveyors are illustrated at 70, and are shown in three individual spans or flights 71, 72, and 73. The air bars mounted directly on the discharge end of the bag-making machine are illustrated at 74, with a plurality of spaced apart bores being illustrated at 75—75. The interior of member 74 is provided with a bore which functions as a compressed air manifold, as previously discussed in connection with the structures of FIGS. 1–4. In this particular embodiment, however, it has been found desirable to utilize a relatively shorter length of air discharging bar or tube, thus achieving a relatively regular or uniform pressure at each of the individual nozzles.

If desired, member 74 may be in the form of a rectangular tube, or, alternatively, in the form of a conventional round tube of a wall thickness sufficient to withstand the pressures to be encountered.

As is illustrated in the embodiment of FIG. 6, a second air discharge system is illustrated as at 76, which is utilized for discharging air to blow the bag onto a receiving station or conveyor. This system includes a plurality of nozzles 77—77 which are disposed above the plane of the product and tend to discharge air against the product so as to cause it to lay out generally flat for ultimate pick-up. While this general type of discharge system has been utilized in the past to control product disposition, it has been found that this system as shown herein may be effectively utilized in combination with the arrangement of the present invention. Specifically, the upper discharge nozzles are arranged to converge downwardly toward the plane of the film product, with the angle of convergence being, preferably, between about 15° and 20°. Furthermore, those discharge orifices which are normally disposed above the ends of the film are arranged to discharge gaseous fluid at an angle to the axis of motion of the product. Specifically, those discharge orifices which are arranged above the ends of the product may diverge outwardly at an angle of approximately 45°, with such a diverging angle being advantageously employed in connection with film products having a lip extension on one end thereof.

In connection with operational pressures, and as has been indicated, supply or manifold pressures in the area of about 10 psi have been found useful for 1/16th inch nozzles spaced one inch on center in order to achieve an effective generation of the Bernoulli effect. Furthermore, supply pressures in excess of approximately 15 psi for these nozzles have been found to be excessive, and lead to the generation of turbulence in the area surrounding the film product. Thus, and as has been previously indicated, supply pressures of between about 5 psi and 15 psi are most useful.

We claim:

1. In combination, conveyor means for sequentially moving flexible plastic film products along a predetermined first plane and axial direction for delivery onto a base pad having a surface forming a stacker input station, and gaseous discharge means for controlling the delivery of said flexible plastic film product onto said stacker input station, said gaseous discharge means comprising:

(a) a plurality of generally parallelly disposed spaced apart gaseous discharge nozzles having discharge orifices disposed generally beneath said predetermined plane and arranged to deliver a flow of compressed gaseous fluid along a second plane generally below said base pad surface, said base pad surface comprising a grid formed of a plurality of generally parallelly disposed spaced apart stationary rods, said discharge nozzles being arranged to deliver said flow along an axis generally parallel to and in said predetermined axial direction; and (b) means for delivering a flow of compressed gaseous fluid to said discharge nozzles under a pressure sufficient to establish a gaseous flow stream induced pressure reduction along said second plane.

2. In combination, conveyor means for sequentially moving flexible plastic film products along a predetermined first plane and axial direction for delivery onto a base pad having a surface forming a stacker input station, and gaseous discharge means for controlling the delivery of said flexible plastic film product onto said stacker input station, said gaseous discharge means comprising:

(a) a plurality of generally parallelly disposed spaced apart gaseous discharge nozzles having discharge orifices disposed generally beneath said predetermined plane and arranged to deliver a flow of compressed gaseous fluid along a second plane generally below said base pad surface, said discharge nozzles being arranged to deliver said flow along an axis generally parallel to said predetermined axial direction, said base pad being a grid formed of spaced apart metal rods, wherein the inter-rod spacing substantially exceeds the diameter of said rod; and (b) means for delivering a flow of compressed gaseous fluid to said discharge nozzles under a pressure sufficient to establish a gaseous flow stream induced pressure reduction along said second plane.

3. In combination, conveyor means for sequentially moving flexible plastic film products along a predetermined first plane and axial direction for delivery onto a base pad having a surface forming a stacker input station, and gaseous discharge means for controlling the delivery of said flexible plastic film product onto said stacker input station, said gaseous discharge means comprising:

(a) a plurality of generally parallelly disposed spaced apart gaseous discharge nozzles having discharge orifices disposed generally beneath said predetermined plane and arranged to deliver a flow of compressed gaseous fluid along a second plane generally below said base pad surface, said discharge nozzles being arranged to deliver said flow along an axis generally parallel to said predetermined axial direction, said base pad being disposed at an inclined angle from said first predetermined plane, the arrangement being such that said base pad diverges from said predetermined plane along the axial direction of delivery of said film products thereon; and (b) means for delivering a flow of compressed gaseous fluid to said discharge nozzles under a pressure sufficient to establish a gaseous flow stream induced pressure reduction along said second plane.

* * * * *